US007791279B2

(12) United States Patent
Kwon et al.

(10) Patent No.: US 7,791,279 B2
(45) Date of Patent: Sep. 7, 2010

(54) FLEXIBLE PLASMA DISPLAY PANEL ASSEMBLY INCORPORTING BASE MEMBERS COUPLED WITH CONNECTION MEMBERS FOR SUPPORTING THE FLEXIBLE PANEL ASSEMBLY

(75) Inventors: Jae-Ik Kwon, Suwon-si (KR); Won-Ju Yi, Suwon-si (KR); Ho-Young Ahn, Suwon-si (KR); Kyoung-Doo Kang, Suwon-si (KR); Dong-Young Lee, Suwon-si (KR); Soo-Ho Park, Suwon-si (KR); Seok-Gyun Woo, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 799 days.

(21) Appl. No.: 11/716,919

(22) Filed: Mar. 12, 2007

(65) Prior Publication Data

US 2007/0228952 A1 Oct. 4, 2007

(30) Foreign Application Priority Data

Mar. 14, 2006 (KR) ..... 10-2006-0023510

(51) Int. Cl.
*H01J 17/49* (2006.01)

(52) U.S. Cl. ..... 313/582; 313/583; 361/679.6; 361/679.22

(58) Field of Classification Search ..... 313/582–587; 361/679.1, 679.22, 679.6
See application file for complete search history.

(56) References Cited

U.S. PATENT DOCUMENTS

2006/0198089 A1* 9/2006 Cho ..... 361/681

FOREIGN PATENT DOCUMENTS

JP 2003036034 A * 2/2003
KR 2005022540 A * 3/2005

* cited by examiner

*Primary Examiner*—Mariceli Santiago
(74) *Attorney, Agent, or Firm*—Knobbe Martens Olson & Bear LLP

(57) ABSTRACT

Provided is a plasma display panel having flexibility. The plasma display panel includes a panel assembly that displays images and has flexibility, a plurality of base members that are attached to a surface of the panel assembly and support the panel assembly, and connection members that connect the base members to each other and are installed to be bent in the same direction as the panel assembly is bent. The base members that support the panel assembly having flexibility on a rear surface of the panel assembly can be bent or folded in the same direction as the panel assembly by the connection members.

12 Claims, 6 Drawing Sheets

FLEXIBLE PLASMA DISPLAY PANEL ASSEMBLY INCORPORTING BASE MEMBERS COUPLED WITH CONNECTION MEMBERS FOR SUPPORTING THE FLEXIBLE PANEL ASSEMBLY

CROSS-REFERENCE TO RELATED PATENT APPLICATION

This application claims the benefit of Korean Patent Application No. 10-2006-0023510, filed on Mar. 14, 2006, in the Korean Intellectual Property Office, the disclosure of which is incorporated herein in its entirety by reference.

BACKGROUND OF THE INVENTION

1. Field of the Invention

The present embodiments relate to a display apparatus, and more particularly, to a flexible display apparatus having a structure in which a base member that is combined with a flexible panel assembly can be folded with the flexible panel assembly.

2. Description of the Related Art

Conventionally, plasma display panels are display panels that display desired numbers, letters, or graphics using light emitted from an excited phosphor material layer formed in a discharge space filled with a discharge gas when ultraviolet rays are generated by applying a predetermined voltage to discharge electrodes formed on each of a plurality of substrates that are facing each other.

Plasma display panels (PDPs) can be classified into direct current (DC) PDPs and alternating current (AC) PDPs according to the type of driving voltage applied to discharge cells, i.e., according to discharge type. PDPs can also be classified into facing discharge PDPs and surface discharge PDPs according to the arrangement of the discharge electrodes.

FIG. 1 is a cross-sectional view illustrating a plasma display panel (PDP) 100.

Referring to FIG. 1, the PDP 100 includes a panel assembly 103 that includes a front substrate 101 and a rear substrate 102, and a base member 104 combined on a rear surface of the panel assembly 103.

An X electrode 105 and a Y electrode 106 are disposed on an inner surface of the front substrate 101, and the X and Y electrodes 105 and 106 are buried in a front dielectric layer 107. A protective layer 108 is formed on a lower surface of the front dielectric layer 107.

Address electrodes 109 are disposed in a direction crossing the X and Y electrodes 105 and 106 on an upper surface of the rear substrate 102, and are buried in a rear dielectric layer 110.

Also, a plurality of barrier ribs 111 are formed between the front substrate 101 and the rear substrate 102. Phosphor layers 112 are formed inner surfaces of the barrier ribs 111.

The base member 104 is installed on a rear surface of the rear substrate 102 while interposed by an adhesive member 113.

The front substrate 101 and the rear substrate 102 are formed as thick glass substrates, and the base member 104 is formed of a metal plate having strength, for example, an aluminum plate to support the panel assembly 103.

The base member 104 is used for various purposes besides supporting the panel assembly 103. That is, the base member 104 absorbs an impact to the panel assembly 103 by an external force, includes an attached driving circuit unit that includes circuit devices on an external surface of the base member 104, grounds electromagnetic waves generated when electrical signals are transmitted between the panel assembly 103 and the attached driving circuit unit, and provides a path for dissipating heat through the panel assembly 103.

A rigid base member limits the use of the panel assembly. Therefore, the development of a structure of a base member that can be folded or rolled up in a certain direction would be advantageous.

SUMMARY OF THE INVENTION

The present embodiments provide a flexible plasma display panel that can be bent with a panel assembly by including connection members between base members that are combined to the panel assembly.

According to an aspect of the present embodiments, there is provided a plasma display panel having flexibility, comprising: a panel assembly that displays images and has flexibility; a plurality of base members that are attached to a surface of the panel assembly and support the panel assembly; and connection members that connect the base members to each other and are installed to be bent in the same direction as the panel assembly is bent.

The base members may be board members disposed consecutively along a direction of the panel assembly.

The wherein the connection members may be coupled to each of the base members by coupling members which are installed on a side of the outer surfaces of the base members and connect the base members into one unit.

The connection members may be flexible materials that consecutively cover outer surfaces of the base members disposed in a predetermined direction.

The plasma display panel may further comprise an adhesive layer on surfaces of the base members facing the panel assembly.

The connection members may be installed between the base members to connect the base members into one unit.

The connection members may be interposed between both edges of each of the base members to simultaneously connect the adjacent base members.

The connection members may be formed of a flexible material so that the base members that are adjacently disposed can be bent in the same direction as the panel assembly is bent.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

The present embodiments will now be described more fully with reference to the accompanying drawings in which exemplary embodiments are shown.

Figure 1:
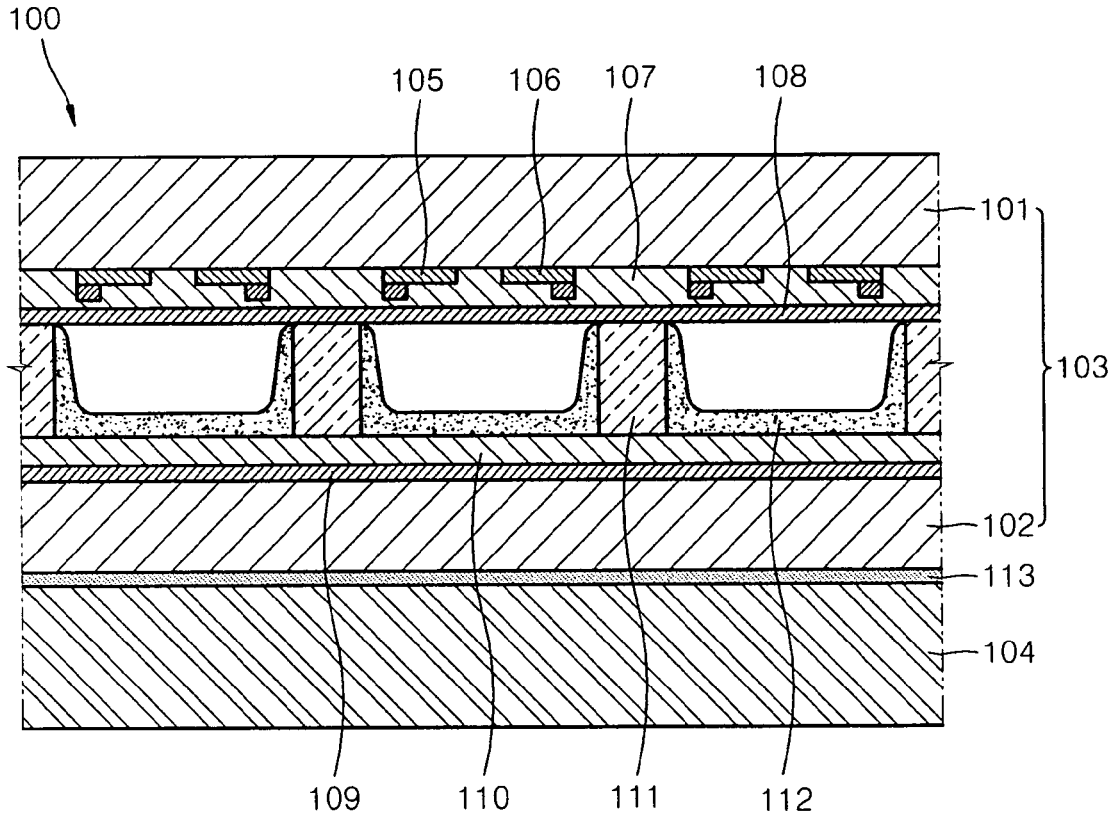
FIG. 1 is a cross-sectional view illustrating a conventional plasma display panel (PDP)
Figure 2:
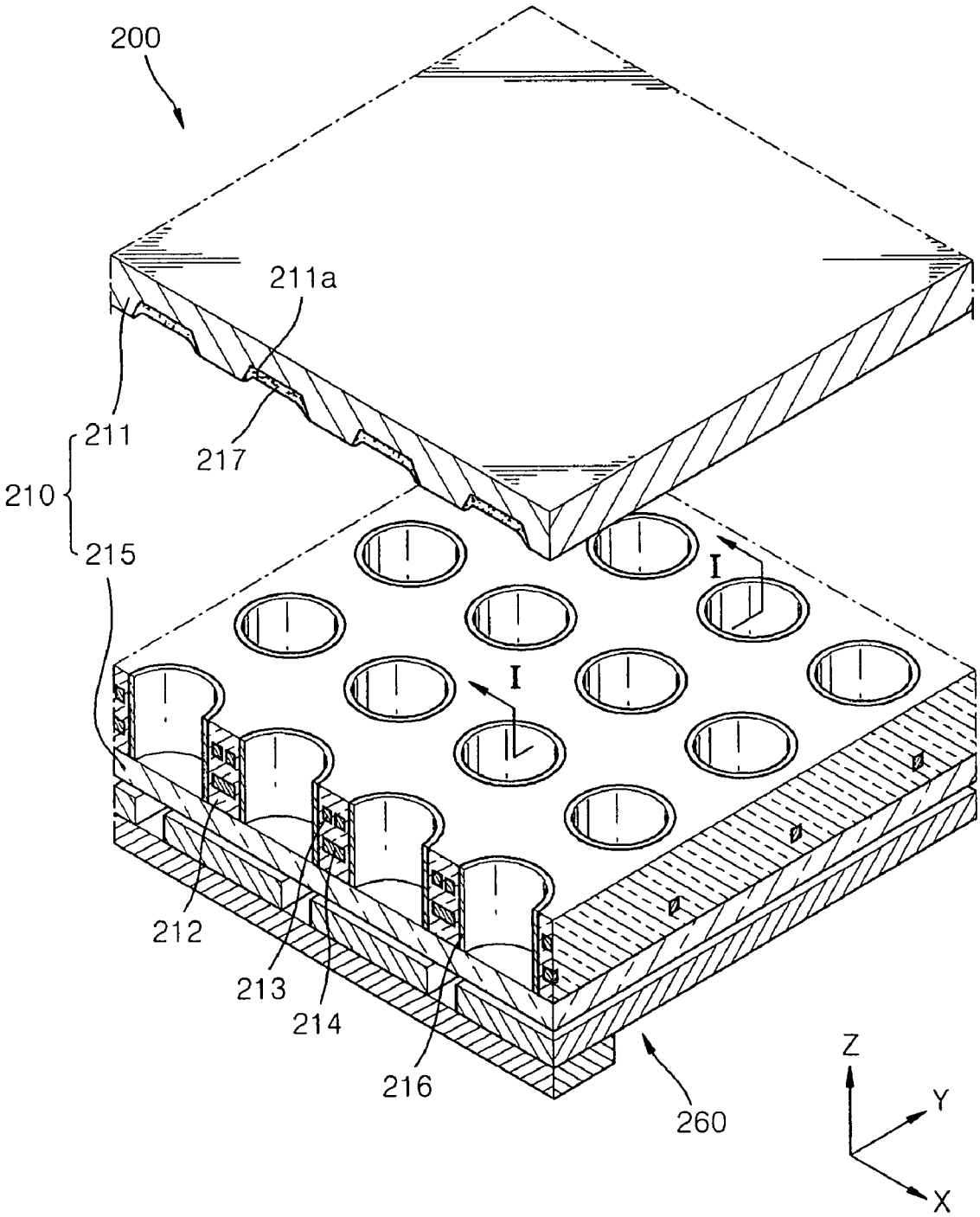
FIG. 2 is a cutaway exploded perspective view illustrating a PDP according to an embodiment.
Figure 3:
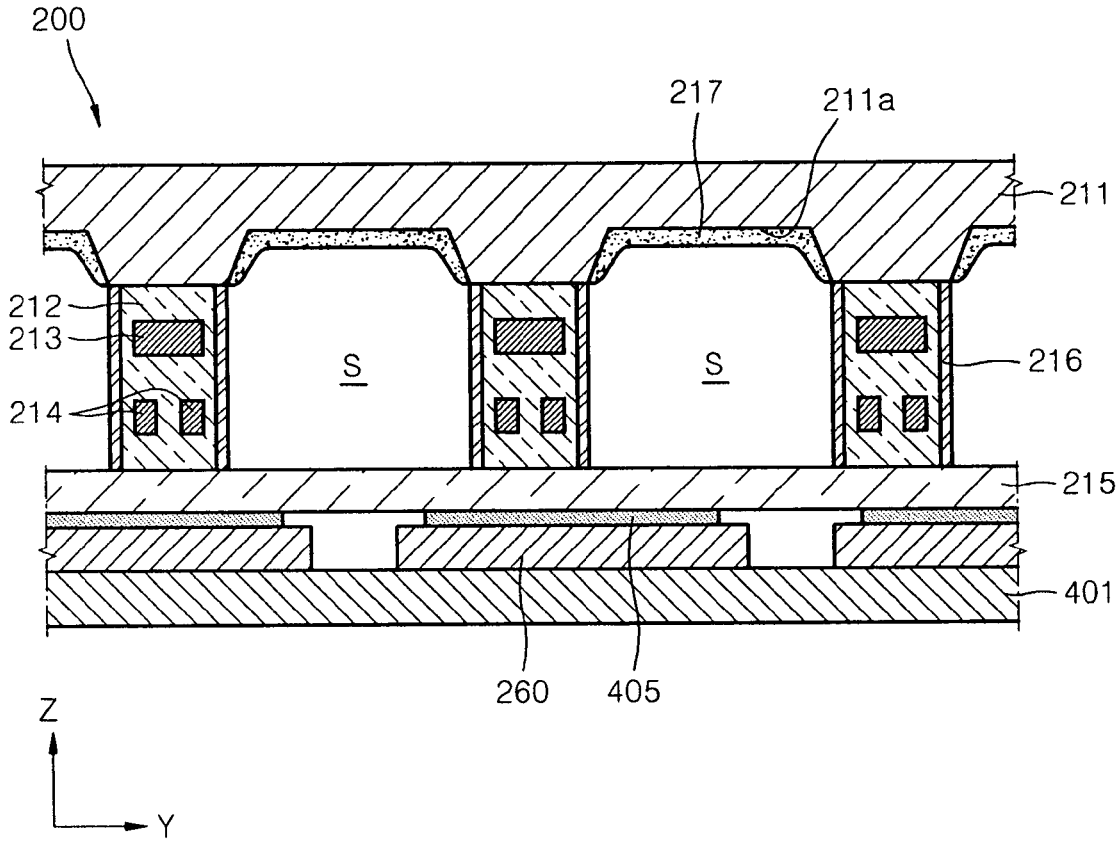
FIG. 3 is a cross-sectional view taken along the line I-I of the PDP illustrated in FIG. 2, according to an embodiment.

FIG. 2 is a cutaway exploded perspective view illustrating a PDP 200 according to an embodiment, and FIG. 3 is a cross-sectional view taken along the line I-I of the PDP 200 illustrated in FIG. 2.

Referring to FIGS. 2 and 3, the PDP 200 includes a panel assembly 210 and a plurality of base members 260 combined with the panel assembly 210.

The panel assembly 210 includes a front substrate 211 and a rear substrate 215. The front substrate 211 can be formed of a transparent plate that has a high optical transmittance. Alternately, the front substrate 211 can be colored or formed of a semi-transparent plate to increase brightness room contrast by reducing reflection brightness.

Barrier ribs 212 are disposed on an inner part of the front substrate 211 to define a space between the front substrate 211 and the rear substrate 215 of discharge cells S and to prevent electrical and optical cross-talk between the adjacent discharge cells S. A plurality of discharge electrode pairs 213 and 214 are immersed in the barrier ribs 212.

The barrier ribs 212 may be formed of a dielectric material having a high dielectric constant that can prevent direct electrical connection between the first discharge electrode 213 and the second discharge electrode 214, prevent the first and second discharge electrodes 213 and 214 from being damaged by positive ions or electrons, and accumulate wall charges by inducing charges.

The barrier ribs 212 form the discharge cells S by having a circular shape horizontal cross-section, but the present embodiments are not limited thereto. That is, the barrier ribs 212 can be formed to any shape as long as the barrier ribs 212 can define a plurality of discharge cells S having a horizontal cross-section, for example, polygon, circular, oval, or non-circular shape, and can define the discharge cells S as a delta type, a waffle type, or a meander type.

The first discharge electrode 213 and the second discharge electrode 214 are disposed in each discharge cell a predetermined distance apart from each other in a perpendicular direction (Z direction) of the PDP 200. The first discharge electrode 213 is disposed relatively closer to the front substrate 211, and the second discharge electrode 214 is disposed relatively closer to the rear substrate 215.

The first discharge electrode 213 extends around the circumference of the discharge cells S disposed along the Y direction of the PDP 200. The first discharge electrode 213 surrounds the circumference of the discharge cell S in an open loop or a closed loop. The first discharge electrode 213 may have a horizontal cross-section that is substantially identical to that of the shape of the discharge cell S.

The second discharge electrode 214 extends around the discharge cells S disposed along an X direction of the PDP 200, which is a crossing direction to that of the first discharge electrode 213. The second discharge electrode 214 is disposed apart from the first discharge electrode 213 in a vertical direction (Z direction) with respect to the front substrate 211 in the barrier ribs 212. The second discharge electrode 214 has a horizontal cross-section substantially identical to that of the shape of the discharge cells S.

The first and second discharge electrodes 213 and 214 are not directly disposed in a region such as an inner surface of the front substrate 211 that can reduce the transmittance of visible light, and thus, can be formed of a metal having high conductivity such as aluminum or copper.

The PDP 200 has a two-electrode structure with the first and second discharge electrodes 213 and 214. One of the first and second discharge electrodes 213 and 214 functions as a scanning and sustain electrode, and the other one of the first and second discharge electrodes 213 and 214 functions as an address and sustain electrode.

Alternately, when the PDP 200 has a three-electrode structure, besides the first and second discharge electrodes 213 and 214 that generate sustain discharges, a third discharge electrode that generates address discharges can further be included in a crossing direction to the second discharge electrode 214.

The rear substrate 215 is disposed on a lower side of the barrier ribs 212. The rear substrate 215 seals a discharge gas filled in the discharge cells S together with the front substrate 211 and the barrier ribs 212 that are disposed between the front substrate 211 and the rear substrate 215.

A protective film layer 216 can be formed on a surface of the barrier ribs 212. The protective film layer 216 prevents the barrier ribs 212 and the first and second discharge electrodes 213 and 214 from being damaged by the sputtering of plasma particles, and, at the same time, functions to reduce a discharge voltage by emitting secondary electrons. The protective film layer 216 can be formed of MgO.

Grooves 211*a* having a predetermine depth are formed on an inner surface of the front substrate 211 corresponding to each of the discharge cells S. The grooves 211*a* are discontinuously formed in each discharge cell S. The grooves 211*a* substantially have the same shape as the discharge cells S.

In the grooves 211*a*, phosphor layers 217 of red, green, and blue colors are formed. Alternately, the phosphor layers 217 can be formed in different locations. For example, the phosphor layers 217 can be formed on inner walls of the barrier ribs 212 or on an inner surface of the rear substrate 215.

The phosphor layers 217 include a component that generates visible light when the component receives ultraviolet rays. The phosphor layers 217 formed in a red light emitting cell include a phosphor material such as $Y(V,P)O_4$:Eu, the phosphor layers 217 formed in a green light emitting cell include a phosphor material such as $Zn_2SiO_4$:Mn or $YBO_3$:Tb, and the phosphor layers 217 formed in the blue light emitting cell include a phosphor material such as BAM:Eu.

A discharge gas such as Ne gas, Xe gas, or a mixture of Ne gas and Xe gas is sealed in the discharge cells S. In the present embodiment, the discharge surface area and the discharge region can be increased, and accordingly, the amount of plasma increases enabling low voltage driving of the PDP. Therefore, a high concentration of Xe gas can be used, thereby greatly increasing luminous efficiency.

The front substrate 211 and the rear substrate 215 can be a flexible substrate formed of, for example, a transparent film, a colored film, or a semi-transparent film. Also, the barrier ribs 212, where the first and second discharge electrodes 213 and 214 are buried, are formed by stacking a plurality of flexible films. Accordingly, the panel assembly 210 has flexibility such that the panel assembly 210 can be bent or folded in a direction.

Here, the base members 260 that can be folded in the same direction as the panel assembly 210 or rolled up in a direction is combined to a rear of the panel assembly 210, which will now be described in detail.

Figure 4:
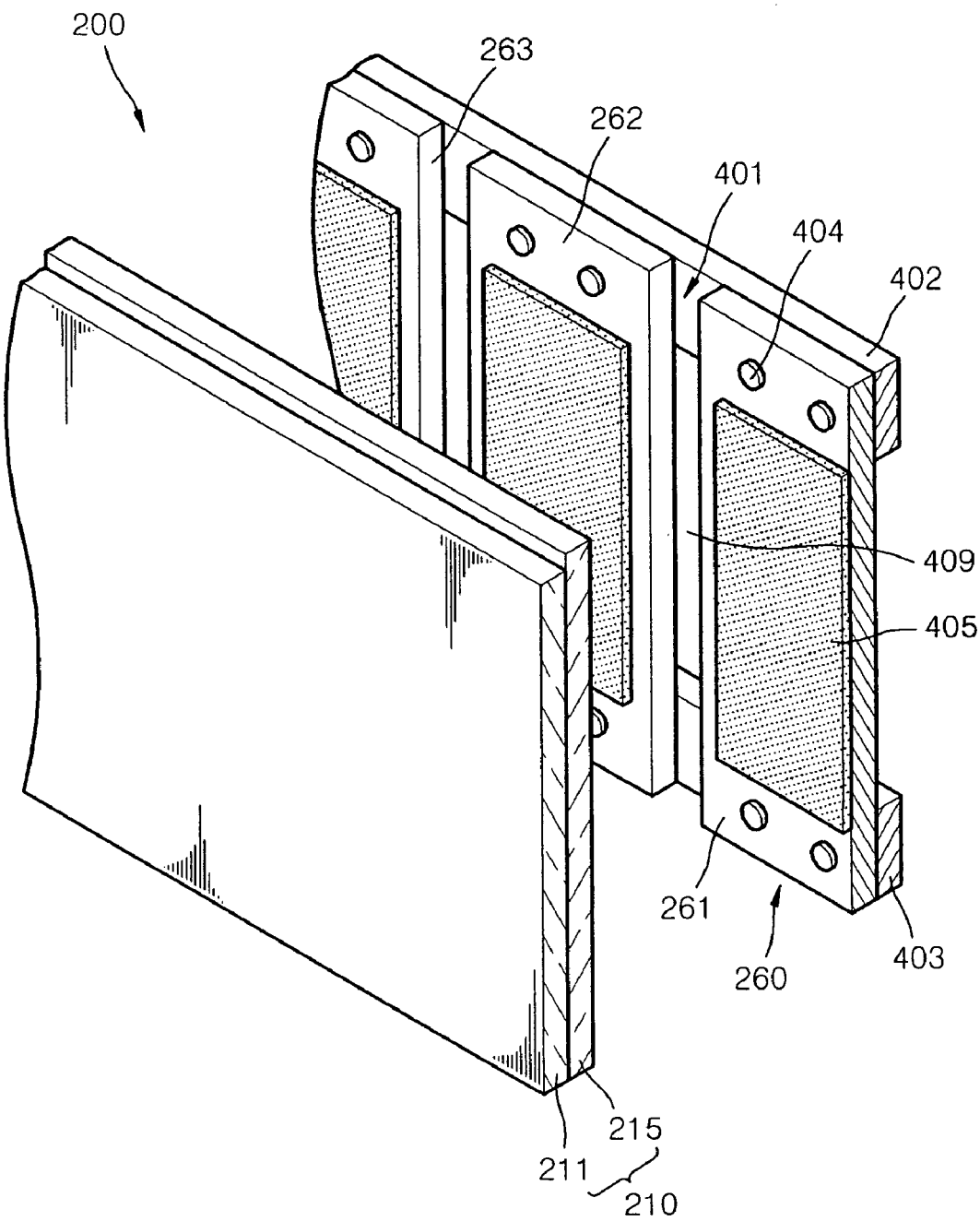
FIG. 4 is a cutaway exploded perspective view illustrating a main portion of the PDP illustrated in FIG. 2, according to an embodiment.
Figure 5:
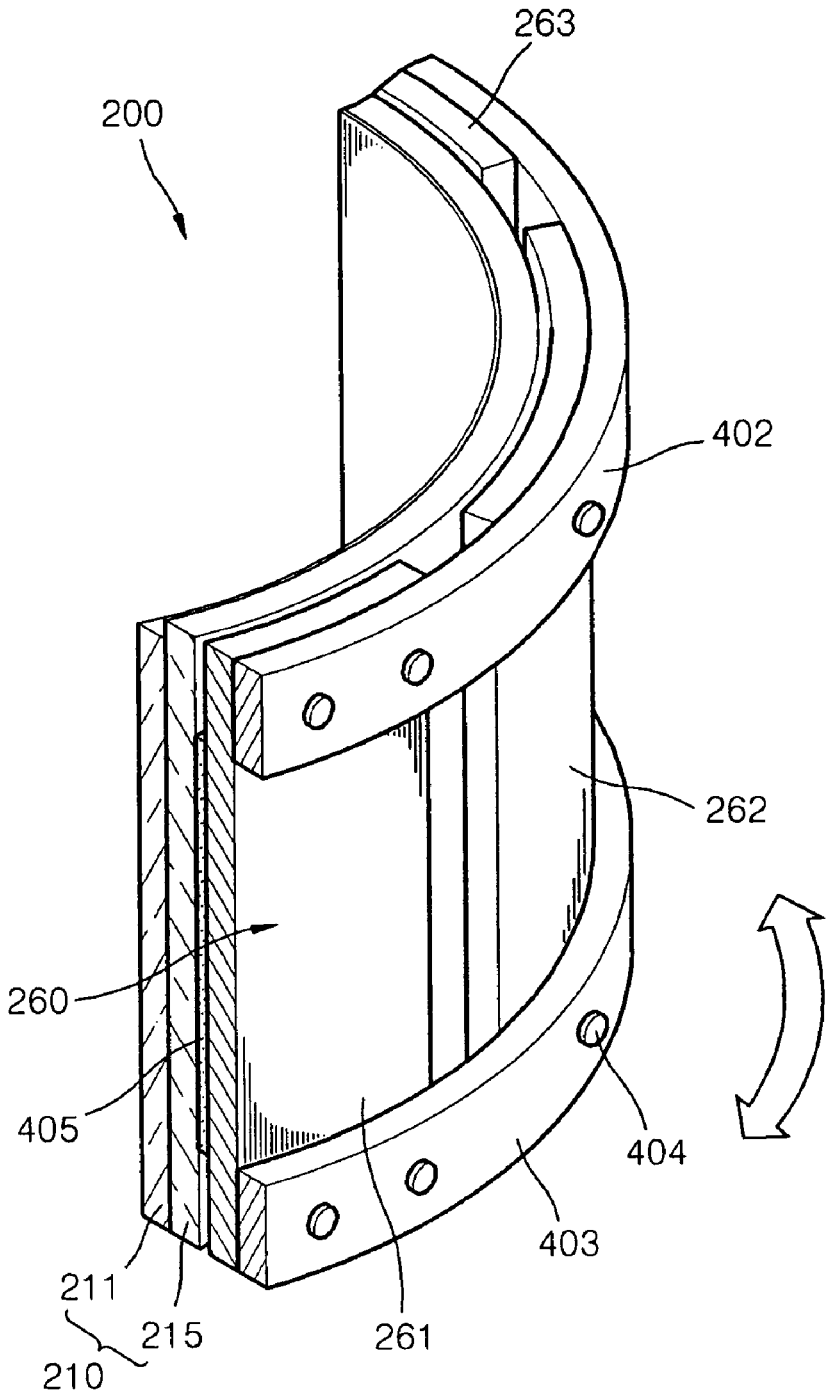
FIG. 5 is a perspective view illustrating the PDP illustrated in FIG. 4 in a folded state, according to an embodiment.

FIG. 4 is a cutaway exploded perspective view illustrating a portion of the PDP 200 illustrated in FIG. 2, according to an embodiment, and FIG. 5 is a perspective view illustrating the PDP 200 illustrated in FIG. 4 in a folded state, according to an embodiment;

Referring to FIG. 4, the base members 260 are disposed on the rear of the panel assembly 210 along a length direction of the panel assembly 210. The base members 260 include a first base member 261, a second base member 262, a third base member 263, through to an nth base member consecutively disposed along a length direction of the panel assembly 210.

Each of the base members 260 can be a board member that may support the panel assembly 210, and may be formed of a material having high thermal conductivity such as aluminum in order to dissipate heat generated by the panel assembly 210.

When the base members 260 are disposed in the length direction of the panel assembly 210, the base members 260 can be installed to completely cover an entire region of the panel assembly 210.

A space portion 409 is formed between base members 260, for example, between the first and second base members 261 and 262, and between the second and the third base members 262 and 263. The purpose of the space portion 409 is to prevent an interfering phenomenon when the base members 260 are bent in a certain direction.

The base members 260 are connected to each other through connection members 401. The connection members 401 that connect the base members 260 are formed of a flexible material so that the base members 260 can be bent in the same direction that the panel assembly 210 is bent.

The connection members 401 include a first connection member 402 installed on upper parts of the base members 260 and a second connection member 403 installed on lower parts of the base members 260. The connection member 401 has a strip shape to connect the base members 260 into one unit by simultaneously connecting on outer surfaces of the base members 260.

The first connection member 402 and the second connection member 403 are coupled to the base members 260 using coupling members 404. The coupling using the coupling members 404 can be performed by various methods such as riveting, screw coupling, or a laser processing.

The first connection member 402 and the second connection member 403 consecutively cover the outer surfaces of the base members 260 disposed in a direction.

An adhesive layer 405 is formed on each of the surfaces of the first through nth base members facing the panel assembly 210. The adhesive layer 405 combines the rear substrate 215 and the base members 260 by interposing between the rear substrate 215 and each of the surfaces of the base members 260. The adhesive layer 405 can be a double-sided tape, a heat dissipation sheet, or a combination of these materials.

In the PDP 200 having the above structure, as depicted in FIG. 5, the base members 260 are attached to the rear surface of the panel assembly 210, and the PDP 200 can be bent or folded in a direction as indicated by the arrow since the first and second connection members 402 and 403 are coupled to the upper and lower outer surfaces of the base members 260 by the coupling members 404.

Figure 6:
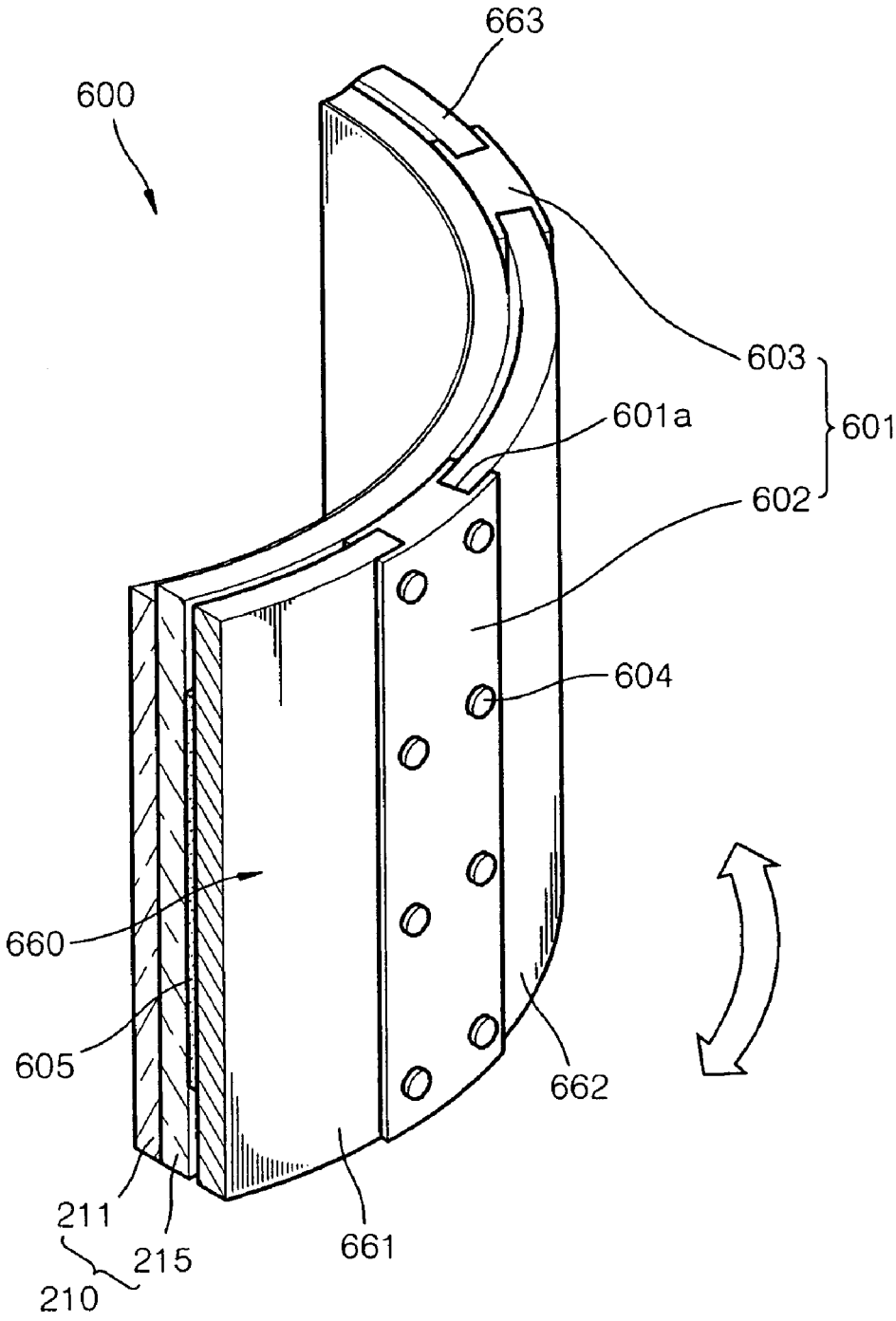
FIG. 6 is a perspective view illustrating a PDP in a folded state, according to another embodiment.

FIG. 6 is a perspective view illustrating a PDP 600 in a folded state, according to another embodiment.

Here, like reference numerals indicate like elements having substantially the same functions as in FIGS. 4 and 5.

Referring to FIG. 6, the PDP 600 includes a panel assembly 210 and a plurality of base members 660 coupled to a rear surface of the panel assembly 210.

The panel assembly 210 includes a front substrate 211 and a rear substrate 215 combined to the front substrate 211. The front substrate 211 and the rear substrate 215 are formed to have flexibility, and thus, can be bent in a direction.

The base members 660 are installed on a rear surface of the rear substrate 215. The base members 660 include a first base member 661, a second base member 662, a third base member 663, nth base member, etc.

The base members 660 are consecutively disposed along a length direction of the panel assembly 210. Also, the base members 660 are formed of a board member having high heat dissipation capabilities to support the panel assembly 210 and to externally dissipate heat generated by the panel assembly 210.

A plurality of connection members 601 is formed in a region corresponding to a gap between base members 660 such as in the region corresponding to the gap between the first and second base members 661 and 662, and in a region corresponding to the gap between the second and the third base members 662 and 663. The connection members 601 connect each of the base members 660 into one unit.

For this purpose, the plurality of connection members 601 include a first connection member 602 disposed in the region corresponding to the gap between the first base member 661 and the second base member 662, and a second connection member 603 disposed in the region corresponding to the gap between the first base member 662 and the second base member 663. The connection member 601 is formed of a flexible material so that the adjacent base members 660 can be bent in the same direction that the panel assembly 210 is bent.

When the connection members 601 are disposed between the base members 660, the connection members 601 have substantially the same height as the base members 660. Insert grooves 601*a* are formed on both edges of the connection members 601 so that the base members 660 can be coupled to the connection members 601 by inserting the base members 660 into the insert grooves 601*a*.

In the insert grooves 601*a*, edge portions of the neighbouring base members 660 are inserted. Accordingly, the base members 660 are consecutively and simultaneously connected by the connection members 601 that are interposed between the base members 660.

The base members 660 can be simultaneously bent in the same direction or can be folded in different directions by the connection of the connection members 601.

The base members 660 that are coupled to the connection members 601 by being inserted into the insert grooves 601*a* can be coupled to the connection members 601 by coupling members 604. The coupling method of using the coupling members 604 can be performed by riveting, screw coupling, or a laser processing, but the present embodiments are not limited thereto.

As described above, in a plasma display panel having flexibility according to the present embodiments, the base members 660 that support a panel assembly having flexibility from a rear surface of the panel assembly can be bent or folded in the same direction as the panel assembly by the connection members 601.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A flexible plasma display panel, comprising:

a flexible panel assembly configured to display images;

a plurality of base members that are attached to a surface of the panel assembly configured to support the panel assembly; and connection members that connect the base members to each other wherein when the panel assembly is bent, the connection members can be bent in the same direction that the panel assembly is bent.

2. The plasma display panel of claim 1, wherein the base members are board members disposed consecutively along a direction of the panel assembly.

3. The plasma display panel of claim 2, wherein the base members are formed to cover an entire region of the panel assembly.

4. The plasma display panel of claim 1, wherein the connection members are coupled to each of the base members by coupling members that are installed on a side of the outer surfaces of the base members and connect the base members into one unit.

5. The plasma display panel of claim 4, wherein the connection members are flexible materials that consecutively cover outer surfaces of the base members disposed in a predetermined direction.

6. The plasma display panel of claim 4, wherein the base members have a space portion therebetween and are coupled to the connection members in a manner such that the base members can be bent in the same direction that the panel assembly is bent.

7. The plasma display panel of claim 1, further comprising an adhesive layer on surfaces of the base members facing the panel assembly.

8. The plasma display panel of claim 1, wherein the connection members are installed between the base members to connect the base members into one unit.

9. The plasma display panel of claim 8, wherein the connection members are interposed between both edges of each of the base members to simultaneously connect the adjacent base members.

10. The plasma display panel of claim 1, wherein the connection members have insert grooves on both edges thereof, and the base members are connected to the connection members.

11. The plasma display panel of claim 1, wherein the connection members are formed of a flexible material so that, when the panel assembly is bent, the base members that are adjacently disposed can be bent in the same direction that the panel assembly is bent.

12. The plasma display panel of claim 1, wherein each of the base members is folded in the same direction or different directions from each other by the coupling of the connection members.

* * * * *